US009994405B2

(12) United States Patent
Itabashi et al.

(10) Patent No.: US 9,994,405 B2
(45) Date of Patent: Jun. 12, 2018

(54) SHEET CONVEYING APPARATUS AND IMAGE FORMING APPARATUS

(71) Applicant: CANON KABUSHIKI KAISHA, Tokyo (JP)

(72) Inventors: Toshifumi Itabashi, Moriya (JP); Keiko Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/447,688

(22) Filed: Mar. 2, 2017

(65) Prior Publication Data

US 2017/0261905 A1 Sep. 14, 2017

(30) Foreign Application Priority Data

Mar. 9, 2016 (JP) ..... 2016-045162

(51) Int. Cl.

| | |
|---|---|
| ***B65H 9/04*** | (2006.01) |
| ***B65H 9/00*** | (2006.01) |
| ***B65H 7/08*** | (2006.01) |
| ***G03G 15/00*** | (2006.01) |

(52) U.S. Cl.

CPC ..... *B65H 9/006* (2013.01); *B65H 7/08* (2013.01); *B65H 9/004* (2013.01); *G03G 15/6529* (2013.01); *B65H 2301/331* (2013.01); *B65H 2801/06* (2013.01)

(58) Field of Classification Search

CPC ... B65H 7/00; B65H 7/08; B65H 7/20; B65H 9/004; B65H 9/006; B65H 9/14; B65H 2301/331; B65H 2513/104

See application file for complete search history.

(56) References Cited

U.S. PATENT DOCUMENTS

| | | | | |
|---|---|---|---|---|
| 6,092,893 | A * | 7/2000 | Yokoi | B65H 5/062 347/104 |
| 6,741,815 | B1 | 5/2004 | Fujita et al. | |
| 7,597,311 | B2 | 10/2009 | Kawata et al. | |
| 7,641,188 | B2 | 1/2010 | Hiura et al. | |
| 7,900,909 | B2 | 3/2011 | Hiura et al. | |
| 8,047,539 | B2 | 11/2011 | Fujita | |
| 8,186,674 | B2 | 5/2012 | Fujita | |

(Continued)

FOREIGN PATENT DOCUMENTS

| | | |
|---|---|---|
| JP | 05-116813 A | 5/1993 |
| JP | 07-157147 A | 6/1995 |

(Continued)

*Primary Examiner* — Prasad V Gokhale

(74) *Attorney, Agent, or Firm* — Fitzpatrick, Cella, Harper & Scinto

(57) ABSTRACT

A sheet conveying apparatus includes a pair of first conveying rollers, a pair of second conveying rollers provided at a downstream of the pair of first conveying rollers in a conveying direction of a sheet, a loop being formed in the sheet when a head of the sheet conveyed by the pair of first conveying rollers butts against the pair of second conveying rollers, and a controller which executes a first control mode in which the sheet is conveyed by the pair of first conveying rollers and the pair of second conveying rollers without dissolving the loop formed in the sheet, or a second control mode in which the loop formed in the sheet is dissolved, and the sheet nipped by the pair of first conveying rollers and the pair of second conveying rollers is conveyed.

28 Claims, 13 Drawing Sheets

(56) References Cited

U.S. PATENT DOCUMENTS

| | | | | |
|---|---|---|---|---|
| 8,238,778 | B2 | 8/2012 | Itabashi et al. | |
| 8,864,123 | B2 | 10/2014 | Kamiyama et al. | |
| 8,979,088 | B2 | 3/2015 | Itabashi | |
| 2010/0111583 | A1 | 5/2010 | Fujita | |
| 2015/0028532 | A1* | 1/2015 | Takahashi | B65H 7/00 271/3.15 |
| 2016/0366295 | A1 | 12/2016 | Matsumoto et al. | |
| 2017/0060066 | A1 | 3/2017 | Fujita | |
| 2017/0068199 | A1* | 3/2017 | Fujita | B65H 7/02 |

FOREIGN PATENT DOCUMENTS

| | | | |
|---|---|---|---|
| JP | 10-212054 | A | 8/1998 |
| JP | 2000-118801 | A | 4/2000 |

* cited by examiner

*FIG. 5*

| SELECTION INPUT INFORMATION OF SHEET (P) | | FEEDING SPEED V1 | IMAGE FORMING SPEED V2 |
|---|---|---|---|
| MATERIAL | BASIS WEIGHT | | |
| SHEET TYPE A | SMALL A $g/m^2$ | 300mm/sec | 264mm/sec |
| | MIDDLE A $g/m^2$ | 250mm/sec | 222mm/sec |
| | HIGH A $g/m^2$ | 150mm/sec | 132mm/sec |
| SHEET TYPE B | SMALL B $g/m^2$ | 300mm/sec | 264mm/sec |
| | MIDDLE B $g/m^2$ | 250mm/sec | 222mm/sec |
| | HIGH B $g/m^2$ | 150mm/sec | 132mm/sec |
| FILM TYPE F | HIGH F $g/m^2$ | 150mm/sec | 132mm/sec |

SHEET CONVEYING APPARATUS AND IMAGE FORMING APPARATUS

BACKGROUND OF THE INVENTION

Field of the Invention

The present invention relates to a sheet conveying apparatus that performs skew feeding correction on a sheet, and an image forming apparatus including the same.

Description of the Related Art

There has been a disclosed conventional technology which butts a head of a sheet against a nip portion of a pair of registration rollers, rotation of which is suspended, to form a loop, and performs skew feeding correction on the sheet (Japanese Patent Laid-Open No. 2000-118801).

However, in the conventional technology, while a head side of the sheet in a conveying direction is subjected to skew feeding correction, a tail side of the sheet in the conveying direction remains in a skew feeding position. Thus, torsion is generated in a loop formed between the pair of registration rollers and a pair of upstream rollers. When the sheet continues to be conveyed in this state, a shear force applied to the sheet gradually increases. When the increasing shear force exceeds rigidity of the sheet, the sheet may kink. Then, there is a concern that a wrinkle may be generated in the sheet when the sheet passes through a nip portion of a pair of downstream registration rollers. This wrinkle is prone to be easily generated in a sheet nipped and conveyed in a long distance by two pairs of rollers that form a loop, or a sheet which easily kinks and has low rigidity. Further, the wrinkle is prone to be noticeably easily generated in an image forming apparatus in which a distance between two pairs of rollers is configured to be short in order to respond to various media such as an envelope whose conveying length is short.

SUMMARY OF THE INVENTION

In this regard, it is desirable to prevent generation of a wrinkle in a sheet after forming a loop.

A sheet conveying apparatus includes a pair of first conveying rollers, a pair of second conveying rollers provided at a downstream side of the pair of first conveying rollers in a conveying direction of a sheet, a loop being formed in the sheet when a head of the sheet conveyed by the pair of first conveying rollers butts against the pair of second conveying rollers, and a controller which executes a first control mode in which the sheet is conveyed by the pair of first conveying rollers and the pair of second conveying rollers without dissolving the loop formed in the sheet, or a second control mode in which the loop formed in the sheet is dissolved, and the sheet nipped by the pair of first conveying rollers and the pair of second conveying rollers is conveyed.

Further features of the present invention will become apparent from the following description of exemplary embodiments with reference to the attached drawings.

BRIEF DESCRIPTION OF THE DRAWINGS

FIG. 5 is a table illustrating a relation between a sheet type and feeding and image forming speeds according to the first embodiment;

DESCRIPTION OF THE EMBODIMENTS

Hereinafter, suitable embodiments of the invention will be illustratively described in detail with reference to drawings. However, dimensions, materials, shapes, relative disposition, etc. of components described in the embodiments below should be appropriately changed according to a configuration or various conditions of an apparatus to which the invention is applied, and the scope of the invention is not intended to be restricted thereto.

First Embodiment (Image Forming Apparatus)

Figure 2:
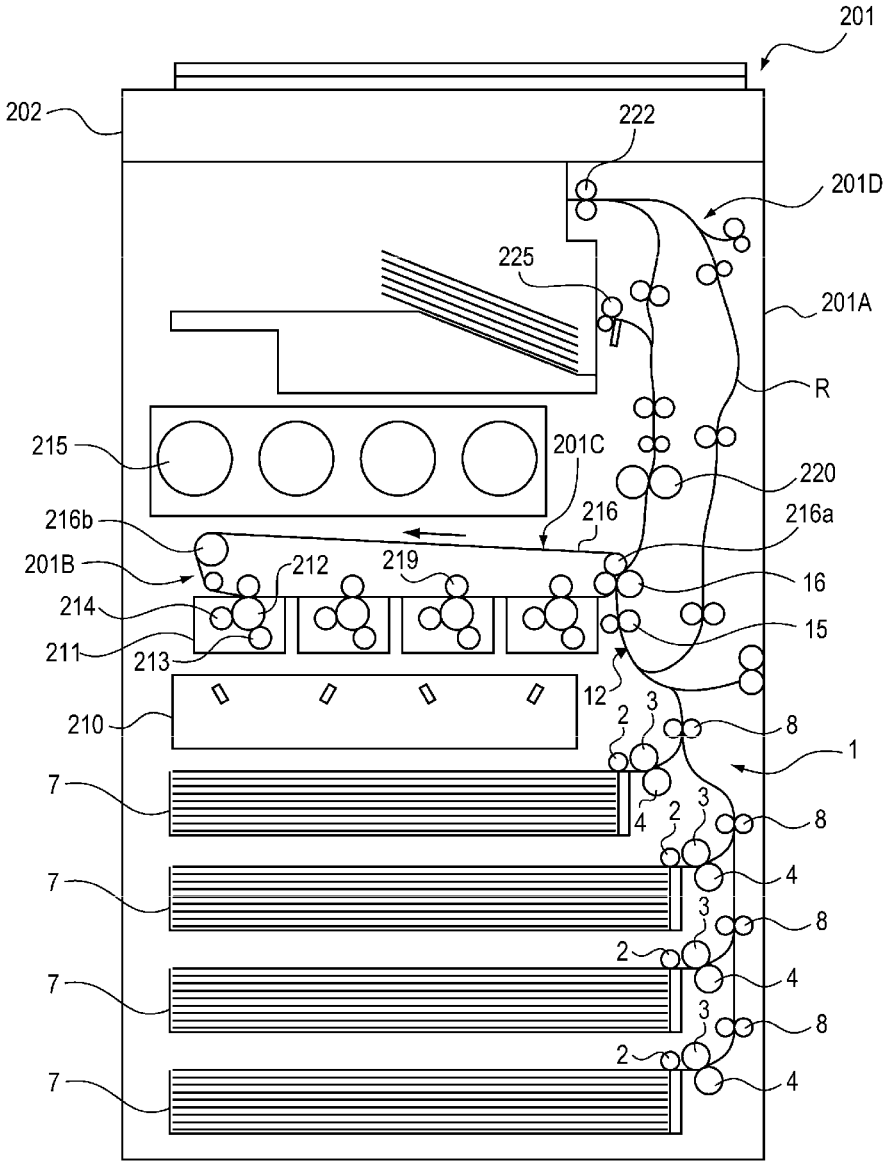
FIG. 2 is a schematic cross-sectional view of an image forming apparatus according to the first embodiment.

FIG. 2 is a diagram illustrating a schematic configuration of a full color laser beam printer corresponding to an example of an image forming apparatus that includes a sheet conveying apparatus according to an embodiment of the invention. FIG. 2 illustrates a full color laser beam copying machine 201, a main printer body 201A corresponding to a main body of the image forming apparatus, an image forming portion 201B that forms an image on a sheet, and a fixing portion 220. An image reading apparatus 202 is an upper apparatus substantially horizontally installed above the main printer body 201A, and a discharge space for discharging a sheet is formed between the image reading apparatus 202 and the main printer body 201A. A sheet conveying apparatus 1 included in a sheet feeding portion is disposed below the main printer body.

The image forming portion 201B corresponds to a four-drum full color scheme, and includes a laser scanner 210 and four process cartridges 211 that form a four-color toner image of yellow (Y), magenta (M), cyan (C), and black (K). Herein, each of the process cartridges 211 includes a photosensitive drum 212, a charging device 213 corresponding to a charging portion, a development device 214 corresponding to a development portion, and a cleaner (not illustrated) corresponding to a cleaning portion. In addition, the image forming portion 201B includes an intermediate transfer unit 201C disposed above the process cartridges 211.

The intermediate transfer unit 201C includes an intermediate transfer belt 216 wound around a drive roller 216*a* and a tension roller 216*b*. The intermediate transfer belt 216 is disposed to come into contact with the respective photosensitive drums 212 and rotates in a direction of an arrow by the drive roller 216*a* which is driven by a drive unit (not illustrated). In addition, the intermediate transfer unit 201C includes primary transfer rollers 219 provided inside the intermediate transfer belt 216 to abut against the intermediate transfer belt 216 at positions opposing the photosensitive drums 212. A secondary transfer roller 16 included in a secondary transfer portion that transfers a color image formed on the intermediate transfer belt 216 to a sheet is provided at a position opposing the drive roller 216*a* of the intermediate transfer unit 201C. A toner cartridge 215 that accommodates a toner of each color is provided above the intermediate transfer unit 201C.

When a transfer bias having positive polarity is applied to the intermediate transfer belt 216 by the primary transfer rollers 219, toner images of respective colors having negative polarity on the photosensitive drums 212 are successively multiple-transferred to the intermediate transfer belt 216.

A sheet fed by the sheet feeding portion is conveyed by a pair of registration rollers 15, and skew feeding is corrected by the pair of registration rollers 15. Then, the sheet is conveyed to the secondary transfer portion by the pair of registration rollers 15 at timing at which a color image formed on the intermediate transfer belt 216 corresponds to a head of the sheet, and the toner image on the intermediate transfer belt 216 is transferred.

The sheet to which the toner image is transferred receives heat and pressure in the fixing portion 220, and the image is fixed as a color image on the sheet. A sheet P on which an image is fixed is discharged to the discharge space by a pair of sheet discharge rollers 225 and loaded therein. When images are formed on both surfaces of a sheet, the sheet P is conveyed to a reconveying path R by a pair of inversion rollers 222 capable of performing bidirectional rotation provided in a double-side inverting portion 201D after an image is fixed, and then conveyed to the image forming portion 201B again.

(Sheet Conveying Apparatus)

Figure 3:
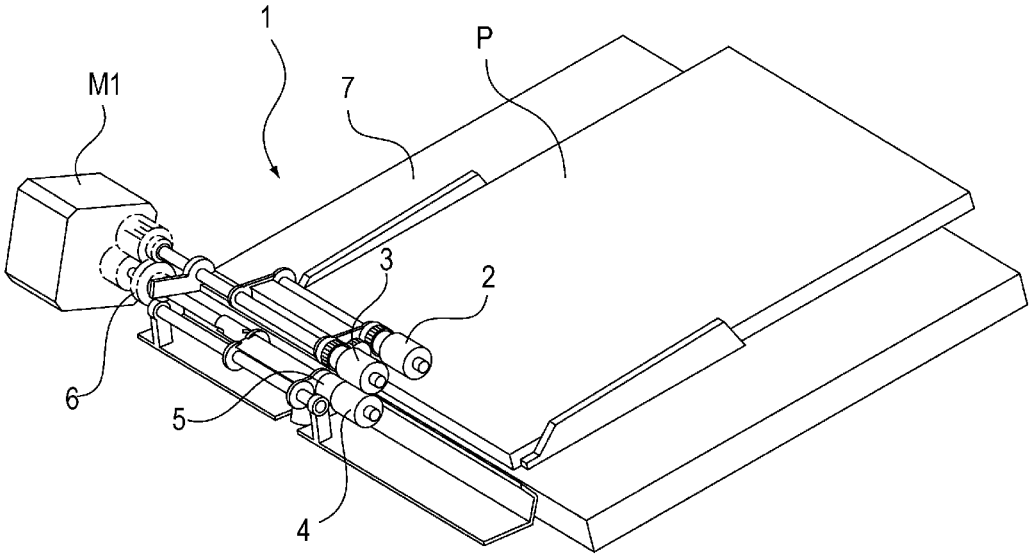
FIG. 3 is a partial perspective view of a sheet feeding apparatus according to the first embodiment.

FIG. 3 is a partial perspective view illustrating the sheet conveying apparatus 1 of the present embodiment. A pickup roller 2, a feed roller 3, and a retard roller 4 arranged in the sheet feeding portion included in the sheet conveying apparatus 1 are driven by a sheet motor M1 corresponding to a common driving source. The feed roller 3 is held on a feed roller shaft 3*a* such that the feed roller 3 may rotate integrally with the shaft. The pickup roller 2 is rotatably held on a spindle 2*b* of a pickup arm 2*a* which may revolve around the feed roller shaft 3*a*. The retard roller 4 is held on a retard roller shaft 4*a* such that the retard roller 4 is rotatable through a torque limiter 5. When the sheet motor M1 is driven, driving is delivered to the feed roller shaft 3*a* through gears 6*a* and 6*b*, and the feed roller 3 rotates. Rotation of the feed roller shaft 3*a* is delivered to the pickup roller 2 through gears 6*c*, 6*d*, and 6*e*, and delivered to the retard roller shaft 4*a* through gears 6*b*, 6*f*, and 6*g*. One-way clutches are interposed between the feed roller 3 and the gear 6*c*, and the feed roller shaft 3*a*, respectively. In this way, even in a state in which driving of the sheet motor M1 is suspended, the feed roller 3 and the pickup roller 2 are not dragged and turned by the sheet P conveyed by a downstream roller to become a conveyance resistance.

When the sheet P is fed, the sheet motor M1 is driven while the pickup roller 2 abuts against an uppermost surface of the sheet P loaded onto a sheet tray 7 at a predetermined urging force. The sheet P drawn by abutting and rotating of the pickup roller 2 is fed up to a separation nip formed by pressing between the feed roller 3 and the retard roller 4.

In a state in which the sheet P is not present at the separation nip, or in a state in which one sheet P is conveyed at the separation nip, a slip of the torque limiter 5 is generated, and the retard roller 4 is dragged and turned in a feeding direction of the sheet P which is reverse to a rotation direction of the retard roller shaft 4*a*. Meanwhile, in a state in which a plurality of overlapping sheets P approaches the separation nip, the retard roller 4 rotates in a driving direction of the retard roller shaft 4*a*. In other words, the sheet P coming into contact with the feed roller 3 is conveyed in the feeding direction, and the sheet P coming into contact with the retard roller 4 is conveyed in a direction of returning to the sheet tray 7 by a slip between multi-fed sheets P.

As described above, the sheets P conveyed to the separation nip are separated one by one by the feed roller 3 and the retard roller 4, and fed to a pair of downstream drawing rollers 8 (see FIG. 2).

The sheet conveying apparatus 1 includes the pair of drawing rollers 8 serving as a pair of first conveying rollers that conveys the sheet, and the pair of registration rollers 15 serving as a pair of second conveying rollers provided at a downstream side of the pair of drawing rollers 8 in a conveying direction of the sheet. The pair of drawing rollers 8 is driven by a drawing motor M2 (see FIG. 4) serving as a first drive portion which is different from the sheet motor M1. The pair of registration rollers 15 is driven by a registration motor M3 (see FIG. 4) serving as a second drive portion which is different from the drawing motor M2.

A head of the sheet P conveyed by the pair of drawing rollers 8 is detected by a registration sensor 12 (see FIG. 2) at a downstream side of the pair of drawing rollers 8, and then the sheet P butts against the pair of registration rollers 15 (see FIG. 2), rotation of which is suspended, to form a registration loop. After suspension for a predetermined time, the sheet P is conveyed to the secondary transfer roller 16, which is included in the secondary transfer portion (transfer portion) that transfers an image to the sheet, by the pair of registration rollers 15 to proceed to an image formation process.

The registration loop is formed in a nip portion of the pair of registration rollers 15 to correct a skew feeding state of the sheet P subjected to skew feeding during conveyance (skew feeding removal), and convey the sheet P free of a tilt or a side slip to the secondary transfer roller corresponding to the image forming portion.

(Control Block Diagram)

Figure 4:
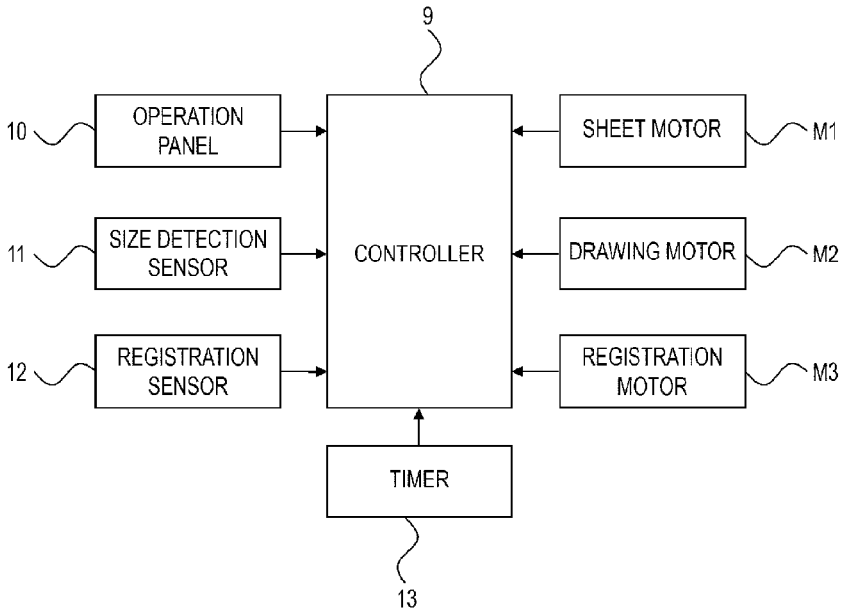
FIG. 4 is a control block diagram of the image forming apparatus according to the first embodiment.

FIG. 4 is a block diagram of a control system in an image forming apparatus 201 of the present embodiment. An operation panel 10 through which a material or a basis weight of the sheet P is selected and input by a user, a size detection sensor 11 that detects a size of the sheet P loaded onto the sheet tray 7, and the registration sensor 12 arranged on a conveying path between the pair of drawing rollers 8 and the pair of registration rollers 15 are connected to a controller 9. In addition, a timer 13 corresponding to a clocking portion is connected to the controller 9. The controller 9 controls operations of the sheet motor M1, the drawing motor M2, and the registration motor M3 based on connected input information.

(Sheet Length)

The size detection sensor 11 detects a sheet length L corresponding to a length of the sheet P in the conveying direction in a size of the sheet P loaded onto the sheet tray 7.

(Feeding Speed)

FIG. 5 is a table illustrating a feeding speed V1 and an image forming speed V2 of the sheet in the image forming apparatus of the present embodiment. The image forming apparatus 201 of the present embodiment has a plurality of image forming speeds V2 depending on the material or the basis weight of the sheet P selected and input by the operation panel 10 since the sheet P of the material or the basis weight having a high heat capacity requires a large heat quantity due to fixing. In other words, a heat quantity per unit time fed to the sheet P is increased by decreasing the image forming speed V2. The image forming apparatus 201 of the present embodiment has a plurality of feeding speeds V1 corresponding to the image forming speeds V2. The heat quantity per unit time fed to the sheet P is increased approximately in proportion to a basis weight and rigidity of the sheet as characteristics of a sheet type of the sheet P.

In the present embodiment, the controller 9 selects one of the plurality of feeding speeds V1 depending on the type of the sheet. Herein, a configuration in which the feeding speed V1 is selected depending on the rigidity of the sheet as the type of the sheet is given as an example. In FIG. 5, the rigidity of the sheet corresponding to stiffness (rigidity) of the sheet is indicated using the basis weight and the sheet type of the sheet, and the feeding speed V1 and the image forming speed V2 of the sheet are selected depending on the rigidity of the sheet.

In addition, FIG. 5 illustrates three types of basis weights as the basis weight of the sheet. A basis weight "small" of the sheet corresponds to a range up to 100 g/m$^2$, a basis weight "middle" corresponds to a range of 101 to 130 g/m$^2$, and a basis weight "high" corresponds to a range greater than or equal to 131 g/m$^2$. Herein, the three types of basis weights corresponding to different ranges are illustrated as the basis weight of the sheet. However, the basis weight is not restricted to the three types, and may be appropriately set as necessary. In addition, the ranges of the three types of basis weights of the sheet are not restricted to the above-described ranges, and may be appropriately set as necessary. Although described below using FIGS. 7A and 7B, when "high" is selected and input as the basis weight of the sheet, the controller selects a feeding speed V1 (herein 150 mm/sec) corresponding to a first conveying speed and executes a first control mode. Meanwhile, when a basis weight other than "large" (herein "small" or "middle") is selected as the basis weight of the sheet, the controller selects a feeding speed V1 (herein 250 mm/sec or 300 mm/sec) corresponding to a second conveying speed, which is faster than the first conveying speed, and executes a second control mode. When the feeding speed V1 is selected, an image forming speed corresponding thereto is selected as the image forming speed V2.

In addition, FIG. 5 illustrates, as sheet types, a sheet type A corresponding to plain paper including pure paper, a sheet type B corresponding to recycled paper, and a film type F corresponding to resin sheet such as OHP sheet. The sheet type B has stronger stiffness (rigidity) than that of the sheet type A. The recycled paper corresponding to the sheet type B illustrated herein has stronger stiffness than that of the plain paper corresponding to the sheet type A. However, a feeding speed may not be changed, and thus feeding speeds V1 and image forming speeds V2 corresponding to respective basis weight of the sheet type A are set to the same speeds as those of the sheet type B as illustrated in FIG. 5. In addition, the resin sheet corresponding to the film type F has stronger stiffness than that of the sheet types A and B described above. In addition, herein, since the OHP sheet is illustrated as the resin sheet, only one type of basis weight "high" is illustrated. These sheet types are selected and input together with the basis weights of the sheets from the operation panel, and the controller selects the feeding speeds V1 and the image forming speeds V2 depending on rigidity of the sheet based on information about the types of the sheets. Specifically, although described below using FIGS. 7A and 7B, the controller 9 selects the first control mode described below when a sheet having a first rigidity is conveyed, and selects the second control mode described below when a sheet having a second rigidity which is lower than the first rigidity is conveyed.

The image forming apparatus including the sheet conveying apparatus according to the present embodiment is executed by selectively switching between the first control mode and the second control mode described below using the controller 9 (see FIG. 4).

(First Control Mode)

Figure 8:
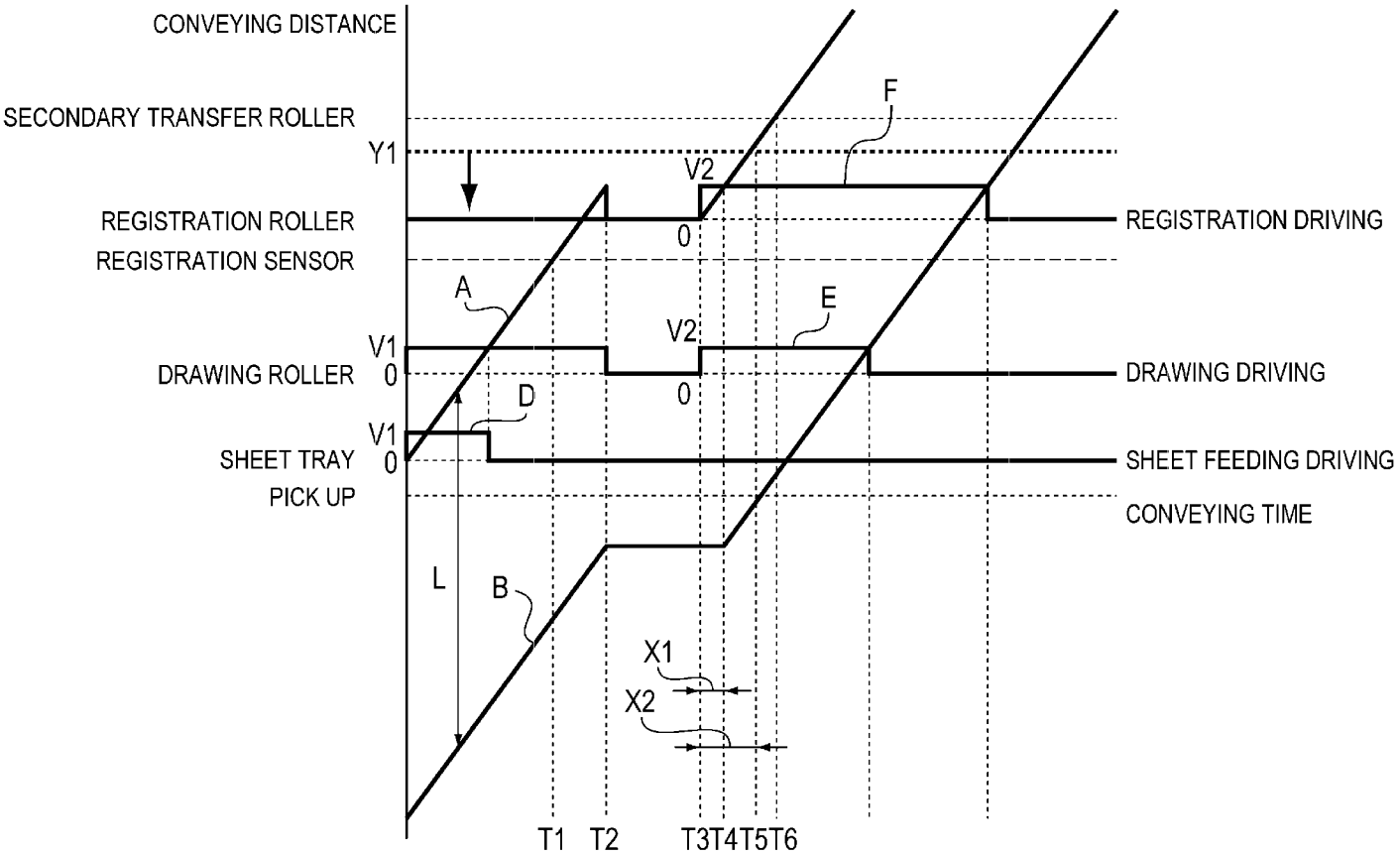
FIG. 8 is a conveyance diagram and a driving diagram according to the first and second embodiments (first control mode)

FIG. 8 is a conveyance diagram and a driving diagram when the feeding speed V1 to which the first control mode of the present embodiment is applied corresponds to the first conveying speed (herein 150 mm/sec).

In FIG. 8, A indicates a theory line of a head position of the sheet P, and B indicates a theory line of a tail position of the sheet P. D indicates a peripheral speed of driving of the pickup roller 2 and the feed roller 3 driven by the sheet motor M1, E indicates a peripheral speed of driving of the pair of drawing rollers 8 driven by the drawing motor M2, and F indicates a peripheral speed of driving of the pair of registration rollers 15 driven by the registration motor M3. V1 denotes the feeding speed, and V2 denotes the image forming speed. The theory line B of the tail position of the sheet P may be obtained by calculation from the theory line A of the head position of the sheet P and the length L of the sheet P detected by the size detection sensor 11.

In the first control mode, the pair of drawing rollers 8 is driven to rotate at a first feeding speed (the feeding speed V1, 150 mm/sec of FIG. 5) by the drawing motor M2. The head position of the sheet P conveyed by the pair of drawing rollers 8 is detected by the registration sensor 12 (control time T1), and the sheet P is conveyed by a distance calculated with respect to the pair of registration rollers 15 which is stopped. In this way, the sheet forms a set registration loop in the nip portion of the pair of registration rollers 15. After the loop is formed, the pair of drawing rollers 8 is stopped (control time T2). After stopping for a set time, the pair of registration rollers 15 starts to convey the sheet P at the image forming speed V2 using the registration motor M3 (control time T3). The pair of drawing rollers 8 starts to convey (starts to rotate) the sheet P (registration ON operation) at the image forming speed V2 (132 mm/sec of FIG. 5) corresponding to the same sheet conveying speed as a sheet conveying speed of the pair of registration rollers 15 using the drawing motor M2.

The conveyance starts at the speed V2 by the pair of drawing rollers 8 at the same time as the control time T3 or starts within a range before a control time T4 is reached in consideration of a control time X1 corresponding to a distance in which the registration loop is dissolved when the pair of drawing rollers is not synchronized. In other words, after the loop is formed, the pair of drawing rollers 8 starts to convey the sheet P at the same time as start of rotation of the pair of registration rollers 15 or before the loop is dissolved. Driving of the pair of drawing rollers 8 and the pair of registration rollers 15 at the speed V2 is turned OFF after a time sufficient for a tail B of the sheet P to pass through each pair of rollers. In the first control mode, the sheet is conveyed without dissolving the loop of the sheet. Therefore, the pair of registration rollers 15 may convey the sheet without receiving back tension, and thus a sheet having a large conveyance resistance due to high rigidity may be stably conveyed.

(Second Control Mode)

Figure 9:
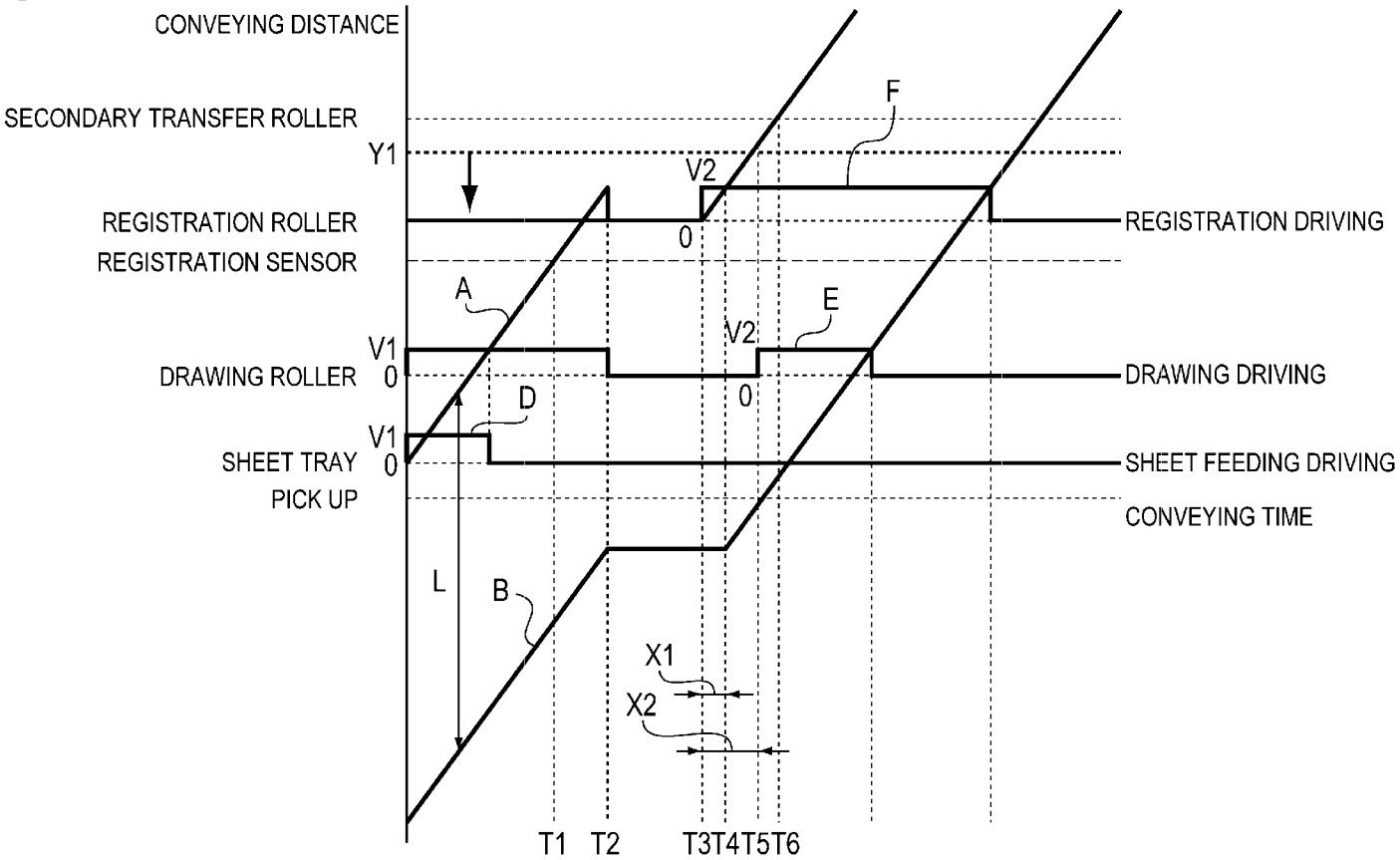
FIG. 9 is a conveyance diagram and a driving diagram according to the first and second embodiments (second control mode)

FIG. 9 is a conveyance diagram and a driving diagram when the feeding speed V1 to which the second control mode of the present embodiment is applied corresponds to the second conveying speed (herein 300 mm/sec or 250 mm/sec), which is faster than the first conveying speed.

Similarly to FIG. 8, in FIG. 9, A indicates a theory line of the head position of the sheet P, and B indicates a theory line of the tail position of the sheet P. D indicates a peripheral speed of driving of the pickup roller 2 and the feed roller 3 driven by the sheet motor M1, E indicates a peripheral speed of driving of the pair of drawing rollers 8 driven by the drawing motor M2, and F indicates a peripheral speed of driving of the pair of registration rollers 15 driven by the registration motor M3. V1 denotes the feeding speed, and V2 denotes the image forming speed. The theory line B of the tail position of the sheet P may be obtained by calculation from the theory line A of the head position of the sheet P and the length L of the sheet P detected by the size detection sensor 11.

In the second control mode, the pair of drawing rollers 8 is driven to rotate at a second feeding speed (the feeding speed V1, 300 mm/sec or 250 mm/sec of FIG. 5) faster than the first conveying speed by the drawing motor M2. The head position of the sheet P conveyed by the pair of drawing rollers 8 is detected by the registration sensor 12 (control time T1), and the sheet P is conveyed by a distance calculated with respect to the pair of registration rollers 15 which is stopped. In this way, the sheet forms a set registration loop in the nip portion of the pair of registration rollers 15. After the loop is formed, the pair of drawing rollers 8 is stopped (control time T2). After stopping for a set time, the pair of registration rollers 15 starts to convey the sheet P at the image forming speed V2 using the registration motor M3 (control time T3). The pair of drawing rollers 8 starts to convey the sheet P (registration ON operation) at the image forming speed V2 (222 mm/sec or 264 mm/sec of FIG. 5) corresponding to the same sheet conveying speed as a sheet conveying speed of the pair of registration rollers 15 using the drawing motor M2 at a control time T5 delayed from the control time T3 by a control time X2.

The control time T5 corresponding to a conveyance start timing of the pair of drawing rollers 8 at the speed V2 is set to be subsequent to the control time T4 in consideration of the control time X1 corresponding to the distance in which the registration loop is dissolved when the pair of drawing rollers is not synchronized and prior to a position control time T6, and within a range of the control time X2 until the head A of the sheet P arrives at a safe position Y1 at which the secondary transfer roller 16 is not touched. The amount by which the pair of registration rollers 15 conveys the sheet is larger than the amount by which the pair of drawing rollers 8 conveys the sheet until the pair of drawing rollers 8 and the pair of registration rollers 15 convey the sheet at the image forming speed V2 after the loop is formed in the sheet. The pair of drawing rollers 8 starts to convey the sheet P after the pair of registration rollers 15 starts to rotate to dissolve the loop after the loop is formed and before the head A of the sheet P arrives at the secondary transfer roller. Driving of the pair of drawing rollers 8 and the pair of registration rollers 15 at the speed V2 is turned OFF after a time sufficient for the tail B of the sheet P to pass through each pair of rollers.

(Configuration of Control Mode of Comparative Example)

Figure 12:
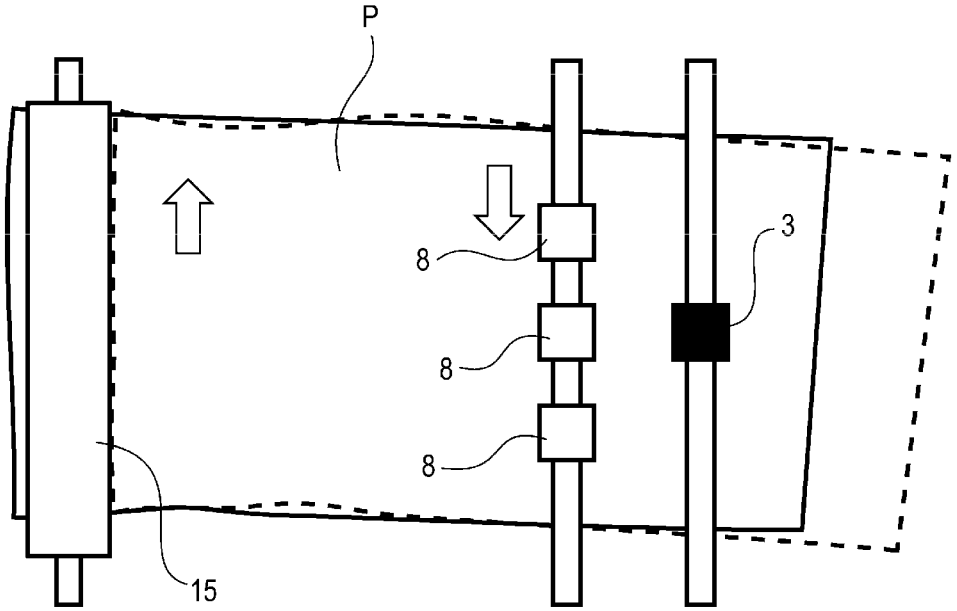
FIG. 12 is a schematic view of disposition of a conveyed sheet and a conveying roller according to a comparative example.

A conventional configuration as a comparative example will be described in describing a configuration of the present embodiment. FIG. 12 is a schematic view of disposition of a conveyed sheet and a conveying roller according to the comparative example. The above-described first control mode is applied to a (conventional) control mode of the comparative example irrespective of a selection state of the feeding speed V1.

The pair of drawing rollers 8 has a configuration in which a nip pressure (welding pressure of the nip portion) is highest among pairs of conveying rollers at an upstream side of the pair of registration rollers 15 in the conveying direction of the sheet, and a range of the nip portion in a thrust direction (roller width in a width direction perpendicular to the conveying direction of the sheet) is not smallest as illustrated in FIG. 12.

In the case in which the registration loop is formed due to skew feeding, after the registration ON operation at the control time T3, while a head side of the sheet is subjected to skew feeding correction, a tail side of the sheet remains in a skew feeding position. For this reason, torsion is generated in a loop formed between the pair of registration rollers 15 and the pair of drawing rollers 8 corresponding to a pair of upstream rollers thereof. When the sheet continues to be conveyed in this state, a shear force applied to the sheet gradually increases. When the increasing shear force exceeds rigidity of the sheet, the sheet may kink. Then, there is a concern that a wrinkle may be generated in the sheet when the nip portion of the pair of registration rollers 15 at a downstream side is passed through. The wrinkle is prone to be easily generated in a sheet nipped and conveyed in a long distance by two pairs of rollers that form a loop, or a sheet which easily kinks and has low rigidity. Further, the wrinkle is prone to be noticeably easily generated when a distance between two pairs of rollers is configured to be short.

(Configuration of Control Mode of Embodiment)

Figure 1:
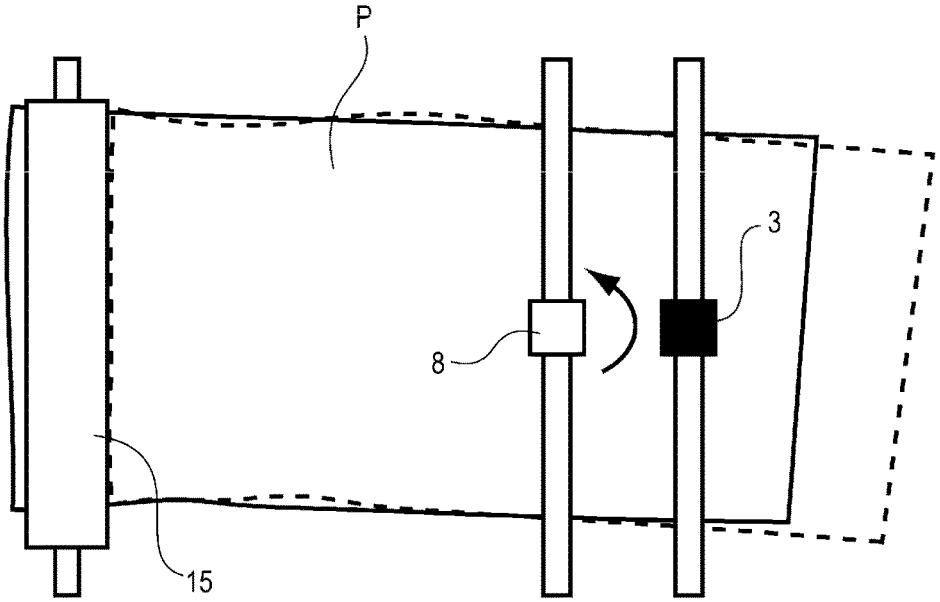
FIG. 1 is a schematic view of disposition of a conveyed sheet and a conveying roller according to a first embodiment.
Figure 6:
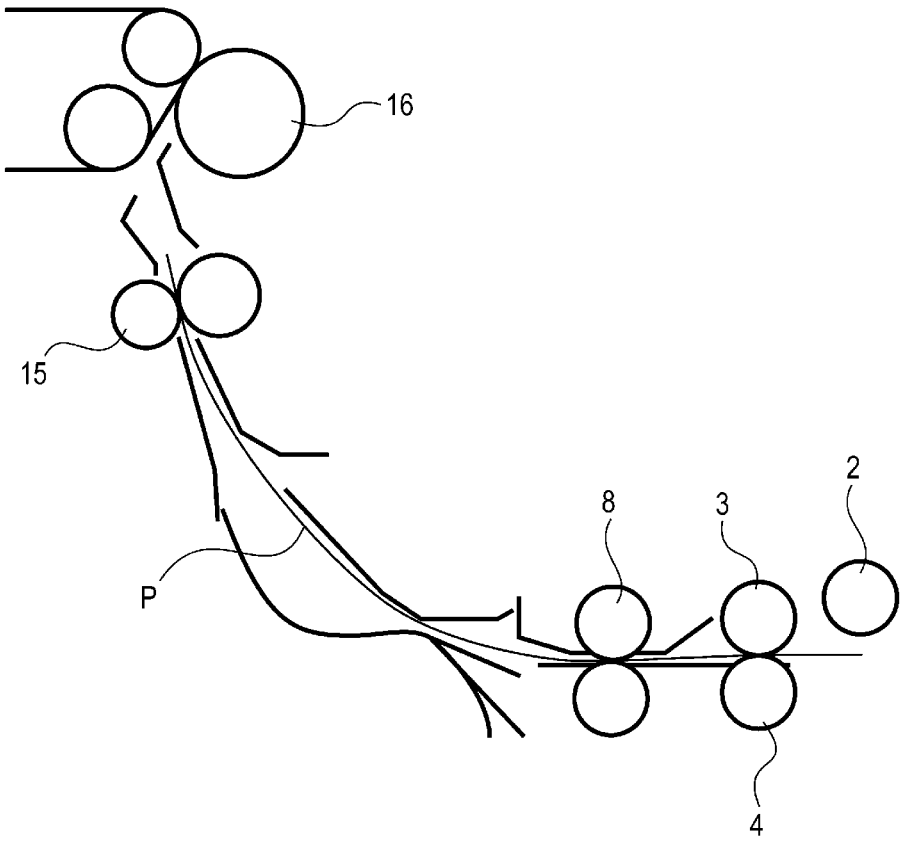
FIG. 6 is a schematic cross-sectional view of a sheet conveying path according to the first embodiment.

FIG. 6 is a schematic cross-sectional view of the image forming apparatus according to the present embodiment, and FIG. 1 is a schematic view of disposition of the conveyed sheet and the conveying roller according to the present embodiment.

In the present embodiment, the feeding speed V1 is set depending on the rigidity (material and basis weight) of the sheet. Further, when the feeding speed V1 set depending on the rigidity of the sheet is the first conveying speed (herein 150 mm/sec illustrated in FIG. 5), the above-described first control mode is applied. Meanwhile, when the feeding speed V1 set depending on the rigidity of the sheet is the second conveying speed (herein 300 mm/sec or 250 mm/sec illustrated in FIG. 5) which is faster than the first conveying speed, the above-described second control mode is applied.

The pair of drawing rollers 8 has a configuration in which a nip pressure (welding pressure of the nip portion) is highest among pairs of conveying rollers at an upstream side of the pair of registration rollers 15 in the conveying direction of the sheet, and a range of the nip portion in a thrust direction (roller width in a width direction perpendicular to the conveying direction of the sheet) is smallest as illustrated in FIG. 1.

In the case in which the registration loop is formed due to skew feeding, after the registration ON operation at the control time T3, while the head side of the sheet is subjected to skew feeding correction, the tail side of the sheet remains in the skew feeding position. For this reason, torsion is generated in a loop formed between the pair of registration rollers 15 and the pair of drawing rollers 8 corresponding to a pair of upstream rollers thereof. When the sheet continues to be conveyed in this state, a shear force applied to the sheet gradually increases.

For this reason, the pair of drawing rollers 8 corresponding to the pair of upstream conveying rollers starts to be driven at the control time T5 corresponding to a conveyance start timing delayed by the control time X2 from the control time T3 corresponding to a conveyance start timing of the pair of registration rollers 15. During the control time X2, the sheet P is pulled to the pair of stopped drawing rollers 8 while being conveyed to the pair of registration rollers 15. Further, since the pair of drawing rollers 8 is a pair of rollers having a high nip pressure and a narrow roller width among pairs of upstream conveying rollers of the pair of registration rollers 15, the sheet P turns while torsion is dissolved by a tensile force of the pair of registration rollers 15 using the pair of drawing rollers 8 as a fulcrum. This turn dissolves torsion of the sheet without increasing a shear force. For this reason, the sheet is prevented from kinking due to the shear force applied to the sheet exceeding the rigidity of the sheet, and generation of a wrinkle in the sheet may be suppressed when the sheet passes through the nip portion of the pair of registration rollers 15 at a downstream side.

Therefore, an image forming apparatus configured such that a distance between two pairs of rollers 8 and 15 forming a loop is short may dissolve the loop before a shear force increases to prevent generation of a wrinkle in a sheet with respect to a sheet having a long conveying distance and low rigidity.

(Control Flowchart)

Figure 7A:
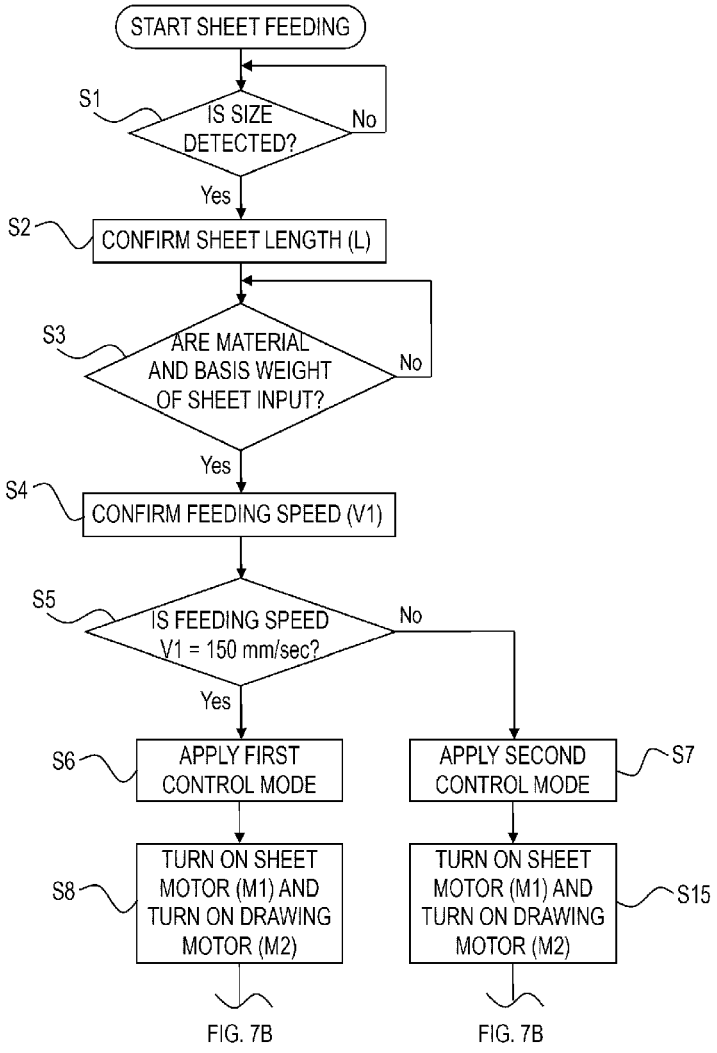
FIGS. 7A and 7B are a feed control flowchart of the image forming apparatus according to the first and second embodiments.
Figure 7B:
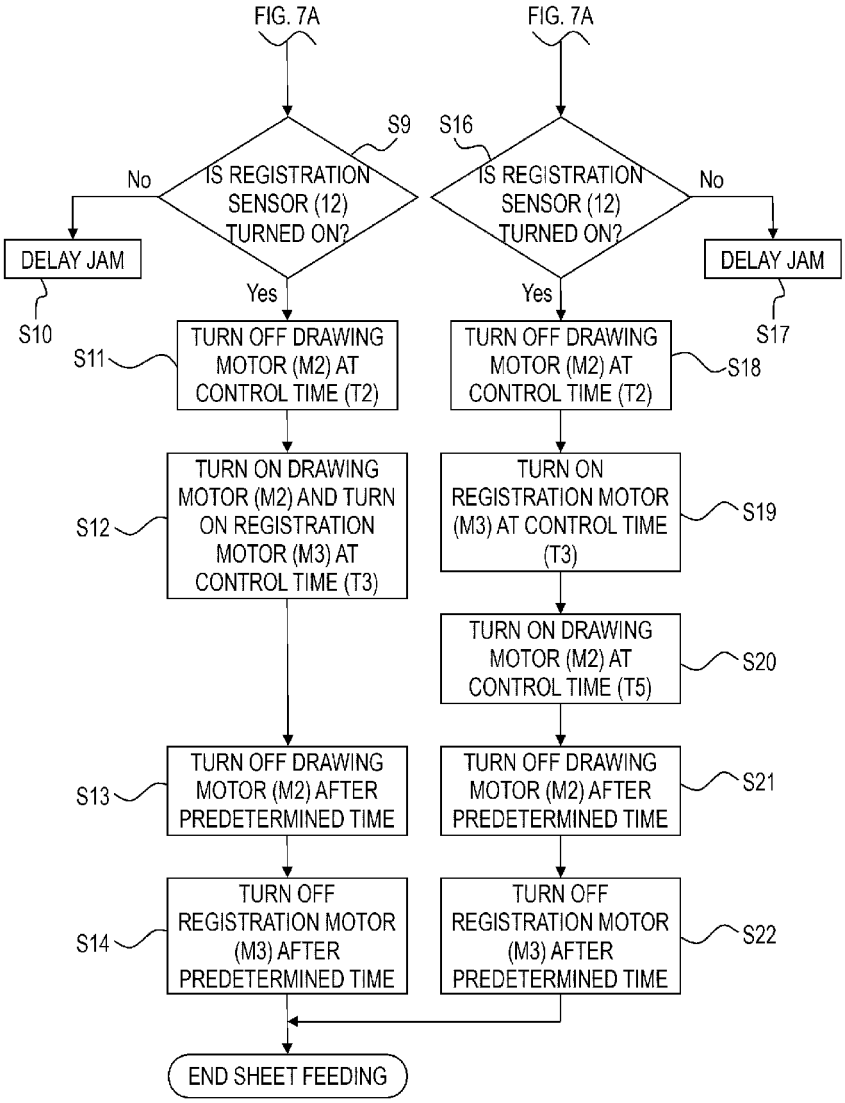

A description will be given of feed control in the image forming apparatus 201 of the present embodiment using a flowchart illustrated in FIGS. 7A and 7B. Feed control described below is performed by the controller 9 illustrated in FIG. 4.

When the sheet P is loaded onto the sheet tray 7, the controller 9 detects a size using the size detection sensor 11 (S1), and confirms the sheet length L (S2). When the user selects and inputs the material and the basis weight of the sheet P on the operation panel 10 (S3), the controller 9 confirms the feeding speed V1 according to FIG. 5 depending on information related to the input type of the sheet (S4). When the feeding speed V1 confirmed from the selected and input material and basis weight of the sheet P is the first conveying speed (herein 150 mm/sec) (S5), the first control mode is applied (S6). Meanwhile, when the feeding speed V1 confirmed from the material and the basis weight of the sheet P is the second conveying speed which is faster than the first conveying speed, the second control mode is applied (S7).

When the sheet motor M1 and the drawing motor M2 start to be driven at the feeding speed V1 (first conveying speed) in the first control mode (S8), the controller 9 detects the head of the sheet P using the registration sensor 12 (S9). When the head of the sheet P does not arrive at the registration sensor 12 within a predetermined time, it is determined that delay JAM is generated (S10). Meanwhile, when the registration sensor 12 detects the head of the sheet P within the predetermined time, the drawing motor M2 is turned OFF at timing of the control time T2 at which the sheet P is conveyed to the pair of stopped registration rollers 15 to form a loop (S11). After forming the loop of the sheet P, the registration motor M3 and the drawing motor M2 are turned ON at the image forming speed V2 corresponding to the confirmed feeding speed V1 at timing of the control time T3 (S12). In this way, the pair of registration rollers 15 is driven to rotate at the image forming speed V2 corresponding to the confirmed feeding speed V1, and the pair of drawing rollers 8 is driven to rotate at the same sheet conveying speed (image forming speed V2) as the sheet conveying speed of the pair of registration rollers 15. Thereafter, the drawing motor M2 is turned OFF for a predetermined time during which the tail of the sheet P passes through the pair of drawing rollers 8 (S13), and the registration motor M3 is turned OFF for a predetermined time during which the tail of the sheet P passes through the pair of registration rollers 15 (S14), thereby completing a feeding operation.

Meanwhile, when the sheet motor M1 and the drawing motor M2 start to be driven at the feeding speed V1 (second conveying speed) in the second control mode (S15), the controller 9 similarly detects the head of the sheet P using the registration sensor 12 (S16). When the head of the sheet P does not arrive at the registration sensor 12 within a predetermined time, it is determined that delay JAM is generated (S17). Meanwhile, when the registration sensor 12 detects the head of the sheet P within the predetermined time, the drawing motor M2 is turned OFF at timing of the control time T2 at which the sheet P is conveyed to the pair of stopped registration rollers 15 to form a loop (S18). After forming the loop of the sheet P, the registration motor M3 is turned ON at the image forming speed V2 corresponding to the confirmed feeding speed V1 (second conveying speed) at timing of the control time T3 (S19). In this instance, the drawing motor M2 remains in the OFF state. Thereafter, the drawing motor M2 is turned ON at the same sheet conveying speed (image forming speed V2) as the sheet conveying speed of the pair of registration rollers 15 at timing of the control time T5 delayed from the control time T3 by the control time X2 (S20). In this way, the pair of registration rollers 15 is driven to rotate at the image forming speed V2 corresponding to the confirmed feeding speed V1, and the loop of the sheet P is dissolved. Further, after the loop of the sheet P is dissolved, the pair of drawing rollers 8 is driven to rotate at the same sheet conveying speed (image forming speed V2) as the sheet conveying speed (image forming speed V2) of the pair of registration rollers 15. Thereafter, the drawing motor M2 is turned OFF for a predetermined time during which the tail of the sheet P passes through the pair of drawing rollers 8 (S21), and the registration motor M3 is turned OFF for a predetermined time during which the tail of the sheet P passes through the pair of registration rollers 15 (S22), thereby completing the feeding operation.

According to the present embodiment, the image forming apparatus configured such that a distance between two pairs of rollers 8 and 15 forming a loop is short may dissolve the loop before a shear force increases to prevent generation of a wrinkle in a sheet with respect to a sheet having a long conveying distance and low rigidity. The registration loop may be reduced without being fully dissolved. In this case, generation of a wrinkle may be prevented.

Second Embodiment (Configuration of Control Mode of Embodiment)

Figure 10:
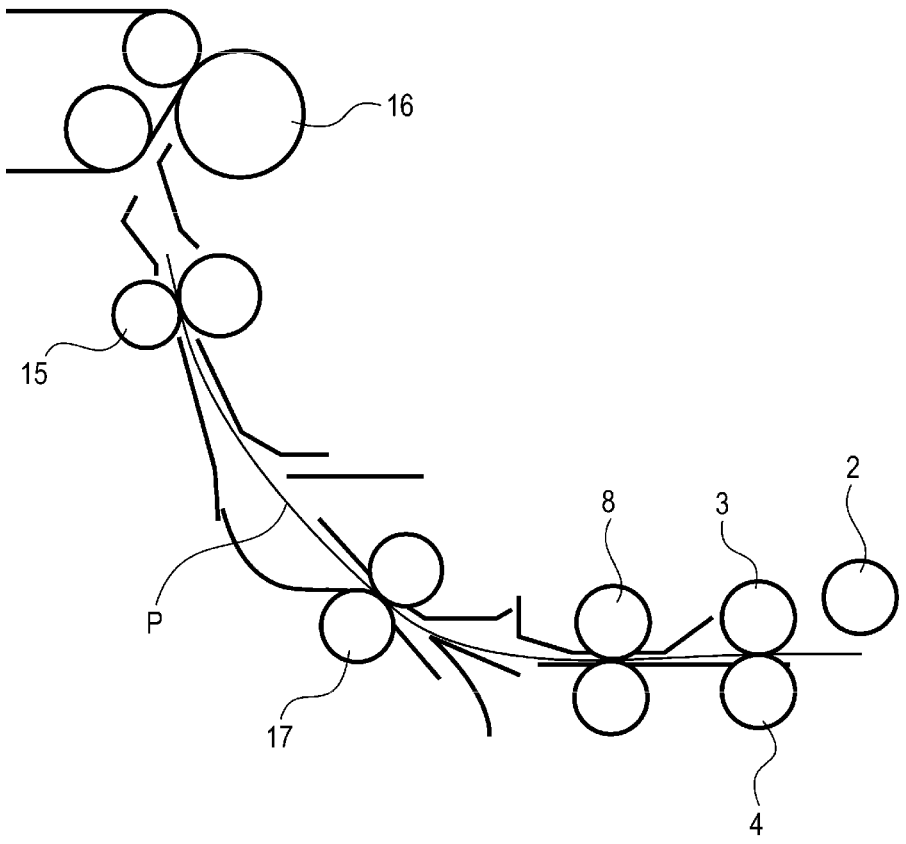
FIG. 10 is a schematic cross-sectional view of an image forming apparatus according to the second embodiment.
Figure 11:
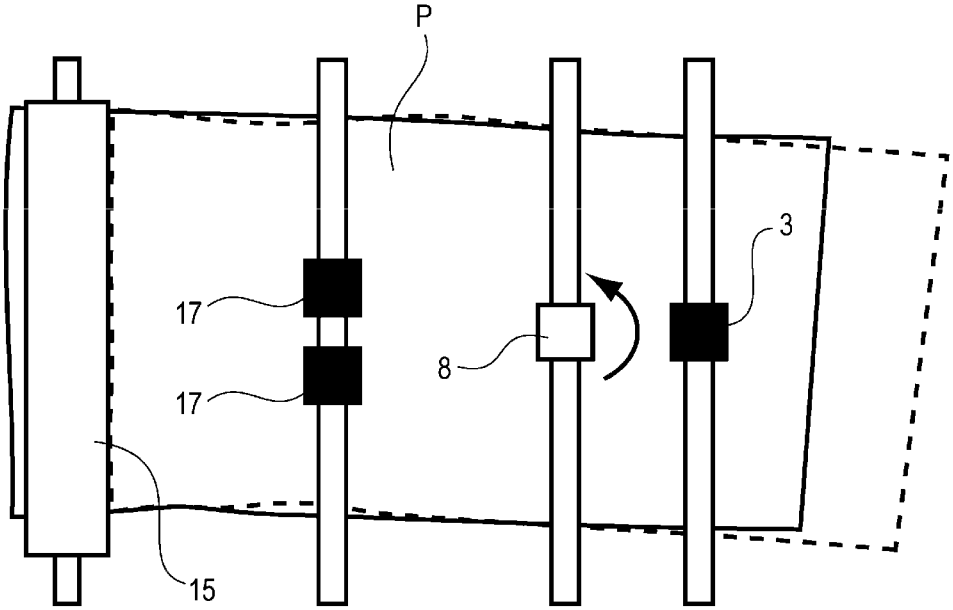
FIG. 11 is a schematic view of disposition of a conveyed sheet and a conveying roller according to the second embodiment.

FIG. 10 is a schematic cross-sectional view of an image forming apparatus according to the present embodiment, and FIG. 11 is a schematic view of disposition of a conveyed sheet and a conveying roller according to the present embodiment.

In the present embodiment, similarly to the above-described first embodiment, a feeding speed V1 is set depending on rigidity (material and basis weight) of a sheet. In other words, when the feeding speed V1 set depending on the rigidity of the sheet is a first conveying speed (herein 150 mm/sec illustrated in FIG. 5), the above-described first control mode is applied. Meanwhile, when the feeding speed V1 set depending on the rigidity of the sheet is a second conveying speed (herein 300 mm/sec or 250 mm/sec illustrated in FIG. 5) which is faster than the first conveying speed, the above-described second control mode is applied.

In the present embodiment, a pair of pre-registration rollers 17 corresponding to a pair of third conveying rollers that conveys the sheet is disposed at a downstream side of a pair of drawing rollers 8 corresponding to a pair of first conveying rollers in a conveying direction of the sheet and at an upstream side of a pair of registration rollers 15 corresponding to a pair of second conveying rollers in the conveying direction of the sheet. In other words, the pair of pre-registration rollers 17 is disposed between the pair of registration rollers 15 and the pair of drawing rollers 8 in the above-described first embodiment. The pair of pre-registration rollers 17 is driven by a different motor from a registration motor M3 or a drawing motor M2 which is controlled by a controller 9. The pair of drawing rollers 8 has a configuration in which a nip pressure (welding pressure of a nip portion) is highest among pairs of conveying rollers at an upstream side of the pair of registration rollers 15, and a range of the nip portion in a thrust direction (roller width in a width direction perpendicular to the conveying direction of the sheet) is smallest as illustrated in FIG. 11. In other words, a nip pressure of the pair of drawing rollers 8 is lower than that of the pair of registration rollers 15 and higher than that of the pair of pre-registration rollers 17. The pair of drawing rollers 8 is configured to have a length in the width direction of the sheet narrower than that of the pair of registration rollers 15 or the pair of pre-registration rollers 17.

In the case in which a registration loop is formed due to skew feeding, after a registration ON operation at a control time T3, while a head side of the sheet is subjected to skew feeding correction, a tail side of the sheet remains in a skew feeding position. For this reason, torsion is generated in a loop formed between the pair of registration rollers 15 and the pair of drawing rollers 8 at an upstream side thereof. When the sheet continues to be conveyed in this state, a shear force applied to the sheet gradually increases.

For this reason, in the present embodiment, the first control mode or the second control mode is selectively executed in the same condition as that in the above-described embodiment. In more detail, the pair of drawing rollers 8 starts to be driven at the control time T3 or a control time T5 corresponding to a conveyance start timing delayed from the control time T3 by a control time X2. In particular, during the control time X2, the sheet P is pulled to the pair of stopped drawing rollers 8 while being conveyed to the pair of registration rollers 15. In the present embodiment, the pair of pre-registration rollers 17 is present between the pair of registration rollers 15 and the pair of drawing rollers 8. However, the pair of pre-registration rollers 17 has a lower nip pressure than that of the pair of drawing rollers 8. For this reason, when driving of the pair of drawing rollers 8 is turned ON at timing of the control time T5, a pulling action of the sheet P is generated between the pair of registration rollers 15 and the pair of drawing rollers 8. In this way, when the pair of drawing rollers 8 is a pair of rollers having a highest nip pressure and a narrow width among pairs of upstream conveying rollers of the pair of registration rollers 15 in the conveying direction of the sheet, the sheet P turns while torsion is dissolved by a tensile force using the pair of drawing rollers 8 as a fulcrum. Similarly, this turn dissolves torsion without increasing a shear force. For this reason, the sheet is prevented from kinking due to the shear force applied to the sheet exceeding the rigidity of the sheet, and generation of a wrinkle in the sheet may be suppressed when the sheet passes through the nip portion of the pair of registration rollers 15 at a downstream side. In the present embodiment, after a loop is formed in the sheet, driving of the pair of pre-registration rollers 17 is turned ON (rotation of the pair of pre-registration rollers 17 starts) at the same time as the pair of drawing rollers 8.

Therefore, an image forming apparatus configured such that a distance between two pairs of rollers 8 and 15 forming a loop is short may dissolve the loop before a shear force increases to prevent generation of a wrinkle in a sheet with respect to a sheet having a long conveying distance and low rigidity.

In the present embodiment, similarly to the pair of drawing rollers 8, the pair of pre-registration rollers 17 functions as a pair of rollers that corrects skew feeding by forming a loop in the sheet between the pair of registration rollers 15. In the sheet P, a length L of the sheet in the conveying direction may be shorter than a length between the pair of registration rollers 15 and the pair of drawing rollers 8. In the case of the sheet P, the pair of registration rollers 15 and the pair of drawing rollers 8 may not correct skew feeding of the sheet. Therefore, the pair of pre-registration rollers 17 functions as a pair of rollers that forms a loop in the sheet when the length of the sheet is shorter than the length between the pair of registration rollers 15 and the pair of drawing rollers 8.

Specifically, an example corresponds to a case in which a sheet having a size of a postcard is conveyed. Here, the length L of the sheet in the conveying direction is short when compared to plain paper, etc. The length L of the sheet in the conveying direction is calculated by the controller 9 based on information from a size detection sensor 11. When the sheet P corresponds to the postcard, first, the size is detected, and the sheet length L is confirmed as described using FIGS. 7A and 7B. Thereafter, a material and a basis weight of the sheet are selected and input. When the sheet corresponds to the postcard, "high" is selected and input as the basis weight. Thus, the first conveying speed (150 mm/sec of FIG. 5) is selected as the feeding speed V1. An image forming speed corresponding to the selected feeding speed V1 is selected as an image forming speed V2. In this way, when the sheet corresponds to the postcard, the first control mode is selected.

Then, in the first control mode, the controller 9 conveys the sheet P to the pair of stopped registration rollers 15 using the pair of pre-registration rollers 17 to form a loop, and suspends driving of the pair of pre-registration rollers 17 after forming the loop. After forming the loop of the sheet P, the pair of registration rollers 15 starts to convey the sheet P at the image forming speed V2 corresponding to the confirmed feeding speed V1 at predetermined timing (control time T3 of FIG. 8). The pair of pre-registration rollers 17 starts to convey the sheet P at the image forming speed V2 corresponding to the same sheet conveying speed as a sheet conveying speed of the pair of registration rollers 15 (registration ON operation). Thereafter, driving of the pair of pre-registration rollers 17 is suspended for a predetermined time during which a tail of the sheet P passes through the pair of drawing rollers 8, and driving of the pair of registration rollers 15 is suspended for a predetermined time during which the tail of the sheet P passes through the pair of registration rollers 15, thereby completing the feeding operation.

As described above, in the present embodiment, a loop may be formed to correct skew feeding with respect to a sheet having a length to which the pair of registration rollers 15 and the pair of drawing rollers 8 may not respond.

In the second control mode, driving of the pair of pre-registration rollers 17 may be turned ON (rotation may be started) at the same time as the pair of registration rollers 15 after a loop is formed in the sheet, and the pair of drawing rollers 8 may start to be rotated after removing the loop. Even when the pair of registration rollers 15 and the pair of pre-registration rollers 17 are rotated at the same time, a loop between the pair of registration rollers 15 and the pair of pre-registration rollers 17 may be reduced by a load of the pair of drawing rollers 8 since a nip pressure of the pair of pre-registration rollers 17 is low when compared to the pair of drawing rollers 8.

Other Embodiments

In the above-described first and second embodiments, the rigidity (material and basis weight) of the sheet is given as an example of a type of the sheet. However, the type of the sheet for confirming a feeding speed is not restricted thereto.

For example, only the basis weight of the sheet may be used as a type of the sheet. In this case, the controller selects the first control mode when a sheet having a first basis weight is conveyed, and selects the second control mode when a sheet having a second basis weight which is smaller than the first basis weight is conveyed. Alternatively, a thickness of the sheet may be used as a type of the sheet. In this case, the controller selects the first control mode when a sheet having a first thickness is conveyed, and selects the second control mode when a sheet having a second thickness which is thinner than the first thickness is conveyed. In this way, similarly to the above-described embodiments, generation of a wrinkle in the sheet may be prevented by selectively implementing a control mode depending on the type of the sheet.

In addition, the above-described embodiments illustrate a configuration in which the same feeding speed is selected when both a sheet type A and a sheet type B have the same basis weight. However, even when the sheet type A and the sheet type B have the same basis weight, if stiffness (rigidity) of a sheet is stronger in the sheet type A than in the sheet type B, the first control mode may be selected when the sheet type A is selected, and the second control mode may be selected when the sheet type B is selected. In this way, the same effect as that of the above-described embodiments may be obtained.

In addition, the above-described embodiments illustrate the feeding speeds V1 depending on three types of basis weights of the sheet, and illustrate a configuration in which the feeding speed V1 of the sheet for selecting a control mode is set to 150 mm/sec or other speeds. However, the invention is not restricted thereto. The first control mode may be selected when the feeding speed V1 confirmed depending on the type of the sheet is the first conveying speed, and the second control mode may be selected when the feeding speed V1 is the second conveying speed faster than the first conveying speed.

In addition, in the above-described embodiments, a printer has been given as an example of the image forming apparatus including the sheet conveying apparatus. However, the invention is not restricted thereto. For example, it is possible to employ other image forming apparatuses such as a scanner, a copying machine, a facsimile machine, etc. or another image forming apparatus such as a compound machine in which these functions are combined. The same effect may be obtained by applying the invention to the sheet conveying apparatus used for these image forming apparatuses.

In addition, above-described embodiments illustrate the sheet conveying apparatus integrally included in an image processor. However, the invention is not restricted thereto. For example, it is possible to employ a sheet conveying apparatus attachable to and detachable from the image forming apparatus, and the same effect may be obtained by applying the invention to the sheet conveying apparatus.

In addition, above-described embodiments illustrate the sheet conveying apparatus that conveys a sheet such as a recording sheet serving as a recording target to the image forming portion. However, the invention is not restricted thereto. For example, the same effect may be obtained by applying the invention to a sheet conveying apparatus that conveys a sheet such as an original serving as a reading target to an image reading portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-045162, filed Mar. 9, 2016, which is hereby incorporated by reference herein in its entirety.

What is claimed is:

1. A sheet conveying apparatus comprising:

a pair of first conveying rollers;

a pair of second conveying rollers provided at a downstream side of the pair of first conveying rollers in a conveying direction of a sheet, a loop being formed in the sheet when a head of the sheet conveyed by the pair of first conveying rollers butts against the pair of second conveying rollers; and a controller which executes a first control mode in which the sheet is conveyed by the pair of first conveying rollers and the pair of second conveying rollers without dissolving the loop formed in the sheet, or a second control mode in which the loop formed in the sheet is dissolved, and the sheet nipped by the pair of first conveying rollers and the pair of second conveying rollers is conveyed.

2. The sheet conveying apparatus according to claim 1, wherein the controller starts to rotate the pair of second conveying rollers after the loop is formed in the sheet and starts to rotate the pair of first conveying rollers such that the loop of the sheet is not dissolved in the first control mode after the loop is formed, and wherein the controller starts to rotate the pair of second conveying rollers after the loop is formed in the sheet and starts to rotate the pair of first conveying rollers after the loop of the sheet is dissolved by a rotation of the pair of second conveying rollers in the second control mode.

3. The sheet conveying apparatus according to claim 1, further comprising:

an acquiring portion configured to obtain an information regarding a type of the sheet, wherein the controller executes the first control mode or the second control mode depending on the information regarding the type of the sheet which is obtained by the acquiring portion.

4. The sheet conveying apparatus according to claim 1, wherein the controller executes the first control mode when a sheet having a first rigidity is conveyed, and executes the second control mode when a sheet having a second rigidity lower than the first rigidity is conveyed.

5. The sheet conveying apparatus according to claim 1, wherein the controller executes the first control mode when a sheet having a first basis weight is conveyed, and executes the second control mode when a sheet having a second basis weight smaller than the first basis weight is conveyed.

6. The sheet conveying apparatus according to claim 1, wherein the controller executes the first control mode when a sheet having a first thickness is conveyed, and executes the second control mode when a sheet having a second thickness thinner than the first thickness is conveyed.

7. The sheet conveying apparatus according to claim 1, wherein the controller executes the first control mode when the sheet is conveyed at a first conveying speed, and executes the second control mode when the sheet is conveyed at a second conveying speed faster than the first conveying speed.

8. The sheet conveying apparatus according to claim 1, wherein a roller width of the pair of first conveying rollers in a width direction perpendicular to the conveying direction of the sheet is smaller than a roller width of the pair of second conveying rollers in the width direction, and is a smallest roller width among other pairs of conveying rollers arranged at an upstream side of the pair of second conveying rollers in the conveying direction of the sheet.

9. The sheet conveying apparatus according to claim 1, wherein a welding pressure in a nip portion of the pair of first conveying rollers is smaller than a welding pressure in the nip portion of the pair of second conveying rollers, and is a largest welding pressure among other pairs of conveying rollers arranged at an upstream side of the pair of second conveying rollers in the conveying direction of the sheet.

10. The sheet conveying apparatus according to claim 1, wherein rotation of the pair of first conveying rollers and rotation of the pair of second conveying rollers are simultaneously started after the loop is formed in the sheet in the first control mode.

11. The sheet conveying apparatus according to claim 1, further comprising:

a transfer portion which transfers an image to a sheet conveyed by the pair of second conveying rollers, wherein the controller starts to rotate the pair of first conveying rollers at a timing later than a timing at which the pair of second conveying rollers starts to rotate after the head of the sheet conveyed by the pair of first conveying rollers butts against the pair of second conveying rollers and before a head of the sheet conveyed by the pair of second conveying rollers arrives at the transfer portion in the second control mode.

12. An image forming apparatus comprising:

the sheet conveying apparatus according to claim 1; and an image forming portion which forms an image on a sheet conveyed by the sheet conveying apparatus.

13. A sheet conveying apparatus comprising:

a pair of first conveying rollers;

a conveying unit comprising a pair of second conveying rollers provided at a downstream side of the pair of first conveying rollers in a conveying direction of a sheet, a loop being formed in the sheet when a head of the sheet conveyed by the pair of first conveying rollers butts against the conveying unit; and a controller which executes a first control mode or a second control mode, wherein in the second control mode, an amount by which the pair of second conveying rollers conveys the sheet is larger than an amount by which the pair of first conveying rollers conveys the sheet during a predetermined period after the loop is formed in the sheet, and wherein a difference between the amount by which the pair of second conveying rollers conveys the sheet and an amount by which the pair of first conveying rollers conveys the sheet is smaller in the first control mode than in the second control mode during the predetermined period after the loop is formed in the sheet.

14. The sheet conveying apparatus according to claim 13, wherein the controller conveys the sheet using the pair of first conveying rollers and the pair of second conveying rollers such that the loop of the sheet is not dissolved after the loop is formed in the sheet in the first control mode, and wherein a time from when the pair of second conveying rollers starts to be rotated until the pair of first conveying rollers starts to be rotated after the loop is formed in the sheet is longer in the second control mode than in the first control mode.

15. The sheet conveying apparatus according to claim 13, further comprising:

an acquiring portion configured to obtain an information regarding a type of the sheet, wherein the controller executes the first control mode or the second control mode depending on the information regarding the type of the sheet which is obtained by the acquiring portion.

16. The sheet conveying apparatus according to claim 13, wherein the controller executes the first control mode when a sheet having a first rigidity is conveyed, and executes the second control mode when a sheet having a second rigidity lower than the first rigidity is conveyed.

17. The sheet conveying apparatus according to claim 13, wherein the controller selects the first control mode when a sheet having a first basis weight is conveyed, and selects the second control mode when a sheet having a second basis weight smaller than the first basis weight is conveyed.

18. The sheet conveying apparatus according to claim 13, wherein the difference between the amount by which the pair of second conveying rollers conveys the sheet until the pair of first conveying rollers and the pair of second conveying rollers convey the sheet at the same speed after the loop is formed in the sheet and the amount by which the pair of first conveying rollers conveys the sheet until the pair of first conveying rollers and the pair of second conveying rollers convey the sheet at the same speed after the loop is formed in the sheet is zero in the first control mode.

19. The sheet conveying apparatus according to claim 13, wherein the controller executes the first control mode in which the sheet is conveyed by the pair of first conveying rollers and the pair of second conveying rollers without dissolving the loop formed in the sheet, or the second control mode in which the loop formed in the sheet is dissolved, and the sheet nipped by the pair of first conveying rollers and the pair of second conveying rollers is conveyed.

20. The sheet conveying apparatus according to claim 13, wherein a roller width of the pair of first conveying rollers in a width direction perpendicular to the conveying direction of the sheet is smaller than a roller width of the pair of second conveying rollers in the width direction, and is a smallest roller width among other pairs of conveying rollers arranged at an upstream side of the pair of second conveying rollers in the conveying direction of the sheet.

21. The sheet conveying apparatus according to claim 13, wherein a welding pressure in a nip portion of the pair of first conveying rollers is smaller than a welding pressure in the nip portion of the pair of second conveying rollers, and is a largest welding pressure among other pairs of conveying rollers arranged at an upstream side of the pair of second conveying rollers in the conveying direction of the sheet.

22. The sheet conveying apparatus according to claim 13, further comprising a transfer portion which transfers an image to a sheet conveyed by the pair of second conveying rollers, wherein the controller starts to rotate the pair of first conveying rollers at a timing later than a timing at which the pair of second conveying rollers starts to rotate after the head of the sheet conveyed by the pair of first conveying rollers butts against the pair of second conveying rollers and before a head of the sheet conveyed by the pair of second conveying rollers arrives at the transfer portion in the second control mode.

23. An image forming apparatus comprising:

the sheet conveying apparatus according to claim 13; and an image forming portion which forms an image on a sheet conveyed by the sheet conveying apparatus.

24. The sheet conveying apparatus according to claim 13, wherein the loop is formed by the head of the sheet conveyed by the pair of first conveying rollers butting the pair of second conveying rollers.

25. The sheet conveying apparatus according to claim 24, wherein rotation of the pair of first conveying rollers and rotation of the pair of second conveying rollers are simultaneously started after the loop is formed in the sheet in the first control mode.

26. The sheet conveying apparatus according to claim 13, wherein the predetermined period after the loop is formed in the sheet is from a first point of time when the pair of second rollers starts conveyance of the sheet to a second point of time when both the pair of first conveying rollers and the pair of second conveying rollers convey the sheet at the same speed.

27. The sheet conveying apparatus according to claim 13, wherein in the first control mode, a difference between a conveying amount by the pair of first conveying rollers and a conveying amount by the pair of second conveying rollers during the predetermined period is zero.

28. The sheet conveying apparatus according to claim 13, wherein in the second control mode, a conveying amount by the pair of second conveying rollers is larger than a conveying amount by the pair of first conveying rollers after the loop is formed on the sheet until the pair of the first conveying rollers and the pair of second conveying rollers convey the sheet at the same speed.

* * * * *